US006579107B1

(12) United States Patent
Sanroma

(10) Patent No.: US 6,579,107 B1
(45) Date of Patent: Jun. 17, 2003

(54) CONNECTOR PIN FOR AN EDGE OF A CIRCUIT BOARD

(75) Inventor: John P. Sanroma, Bedford, MA (US)

(73) Assignee: Osram Sylvania, Danvers, MA (US)

( * ) Notice: Subject to any disclaimer, the term of this patent is extended or adjusted under 35 U.S.C. 154(b) by 0 days.

(21) Appl. No.: 10/211,445

(22) Filed: Aug. 2, 2002

Related U.S. Application Data

(60) Provisional application No. 60/347,405, filed on Jan. 10, 2002.

(51) Int. Cl.[7] ..... H01R 12/00

(52) U.S. Cl. ..... 439/79; 439/876; 439/59; 439/78

(58) Field of Search ..... 439/79, 59, 82, 439/78, 872, 876, 943, 746

(56) References Cited

U.S. PATENT DOCUMENTS 3,858,957 A * 1/1975 Harwood et al. ..... 439/59
5,782,644 A * 7/1998 Kiat ..... 439/79
5,876,221 A * 3/1999 Sasaki ..... 439/79

FOREIGN PATENT DOCUMENTS

JP 2-27672 * 1/1990 ..... 439/876

* cited by examiner

*Primary Examiner*—Tho D. Ta
(74) *Attorney, Agent, or Firm*—William E. Meyer

(57) ABSTRACT

A connector pin includes an electrically conductive rod having a first end that extends longitudinally from an edge of a circuit board. The rod includes a plug at an opposite end of the rod that is inserted into an electrical receptacle on the circuit board. The plug is orthogonal to a longitudinal axis of the rod. A clamping pivot arm is between the first end and the plug and is parallel to the plug. The clamping pivot arm terminates with a hook whose end points toward the plug. The connector pin is pivoted about the clamping pivot arm pivotally so that the plug is inserted into the receptacle on the circuit board. The edge of the circuit board has a notch therein and the clamping pivot arm engages the notch to prevent lateral movement of the connecting pin. The plug and the clamping pivot arm prevent longitudinal movement of the connecting pin.

17 Claims, 3 Drawing Sheets

CONNECTOR PIN FOR AN EDGE OF A CIRCUIT BOARD

The Applicant hereby claims the benefit of his provisional application, Ser. No. 60/347,405 filed Jan. 10, 2002 for Pin Connector For Circuit Board Edge.

BACKGROUND OF THE INVENTION

The present invention is directed to a connecting pin for a circuit board, and more particularly to a connecting pin that extends longitudinally from an edge of a circuit board. The invention is also directed to a combination of the connecting pin and the circuit board.

Circuit boards are typically electrically connected to a fitting by positioning the circuit board so that the connecting pins at an edge of the circuit board are aligned with suitable connections on the fitting and then moving the board so that the connecting pins are inserted into the connections. The circuit board may be removed and reinstalled numerous times, and during these repetitions, the parts that hold the connecting pins to the circuit board may weaken. This may lead to complete loss of a connecting pin and permanent damage to the circuit board.

SUMMARY OF THE INVENTION

An object of the present invention is to provide a novel connecting pin that avoids this problem by providing the connecting pin with arms that act together to hold the connecting pin to the circuit board, thereby strengthening an attachment of the connecting pin to the circuit board.

A further object of the present invention is to provide a novel connecting pin that has a plug at an end opposite the insertion end of the pin and that extends in a direction transverse to a longitudinal axis of the insertion end, and a clamping pivot arm that is parallel to the plug and between the insertion end and the plug, where the clamping pivot arm has a hook that pivotally engages an edge of a circuit board and that holds the connector pin in place on the edge of the circuit board when the connecting pin is pivoted about the clamping pivot arm and the plug is inserted into a receptacle in the circuit board.

A yet further object of the present invention is to provide a combination of this connecting pin with a circuit board, where the circuit board has a notch on its edge for receiving the hook.

DESCRIPTION OF PREFERRED EMBODIMENTS

Figure 1:
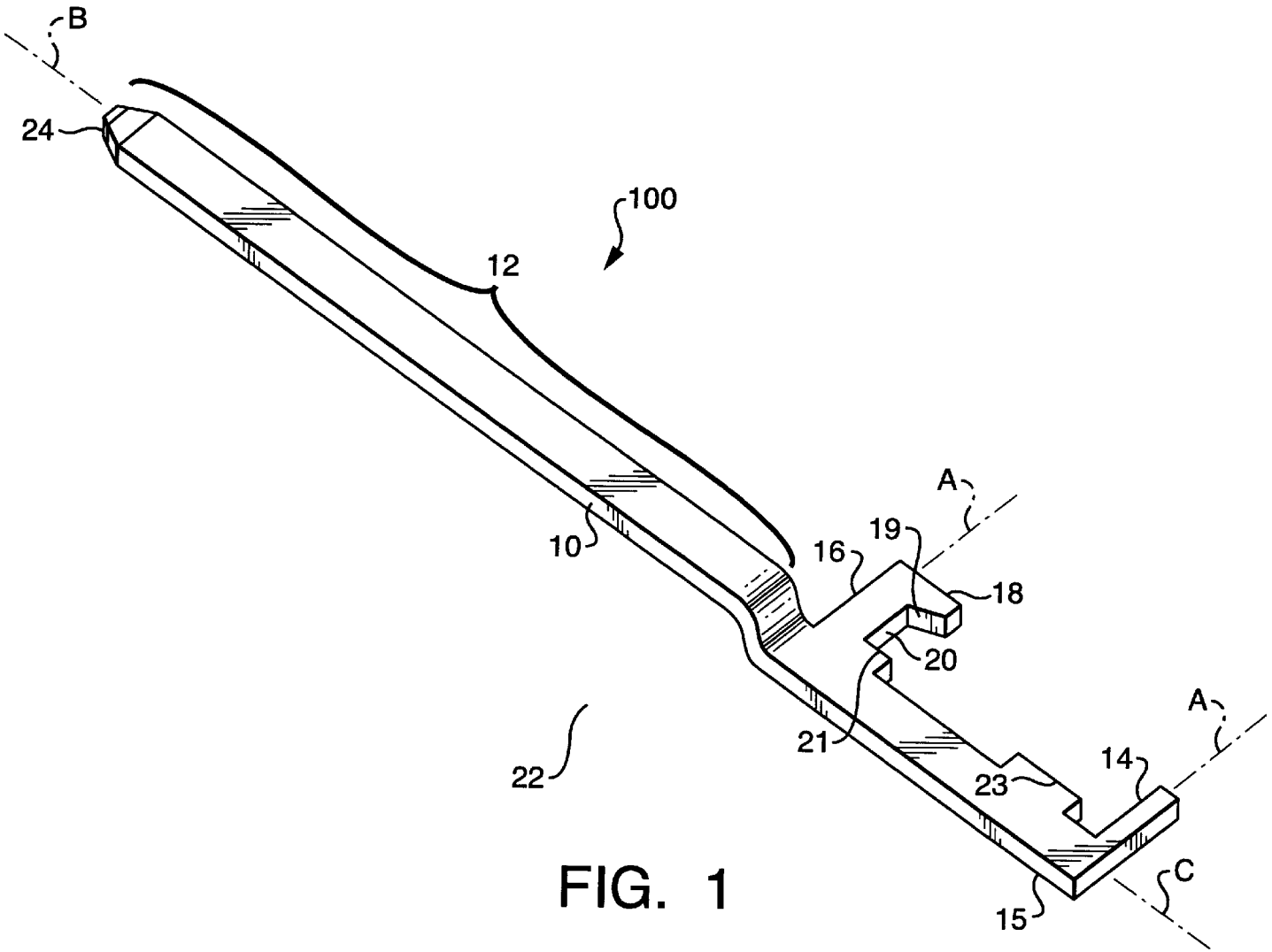
FIG. 1 is a perspective view of a first embodiment of a connecting pin of the present invention.

With reference now to FIG. 1, a first embodiment 100 of the present invention may include an electrically conductive rod 10 having a first end 12 that is adapted to extend longitudinally from an edge of a circuit board. An electrically conductive side-wise plug 14 is attached to rod 10 at or adjacent to a second end 15 of rod 10 opposite first end 12 and is adapted to be inserted into an electrical receptacle in a circuit board. Plug 14 extends in a first direction A transverse (e g., orthogonal) to a longitudinal axis B of first end 12. A clamping pivot arm 16 is attached to rod 10 between first end 12 and plug 14. Clamping pivot arm 16 extends in the first direction A and terminates with a hook 18 that points toward plug 14. A lower limb 19 of hook 18 may be separated from an opposing surface 21 of rod 10 by a distance that corresponds to a thickness of a circuit board.

Clamping pivot arm 16 has a pivot face 20 that pivotally engages an edge of a circuit board. Clamping pivot arm 16 and plug 14 hold connector pin 100 in place on the edge of the circuit board when the connector pin is pivoted on pivot face 20 and plug 14 is inserted into a receptacle in the circuit board.

Longitudinal axis B of first end 12 may be offset from a longitudinal axis C of a portion of rod 10 between clamping pivot arm 16 and plug 14 by adding an S-shaped portion 22. The reason for this will be apparent from the discussion of the second embodiment.

Rod 10, plug 14, and clamping pivot arm 16 may be a single piece of electrically conductive metal of suitable strength and rigidity. Since connecting pin 100 will be pivoted about pivot face 20 during insertion, rod 10 should be rigid enough to withstand this motion. A boss 23 may be formed on rod 10 between the plug 14 and pivot face 20 forming a positioning surface to brace against the circuit board.

First end 12 may terminate in a tapered end 24 for longitudinal and electrically conductive insertion into an external fitting.

Figure 2A:
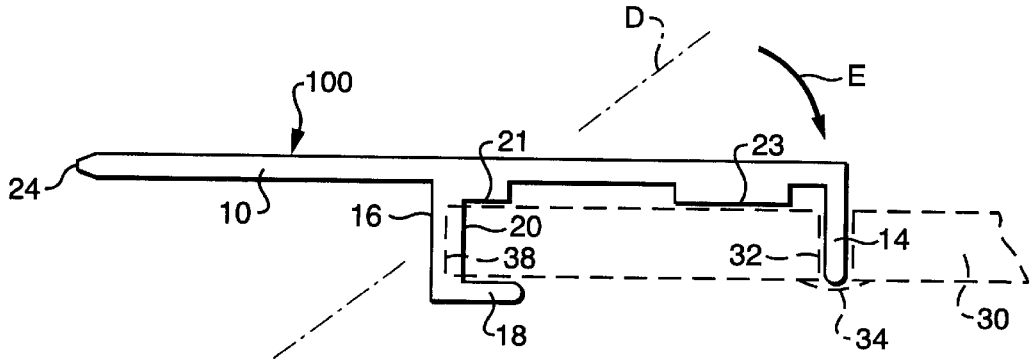
FIG. 2*a* is a side view of the first embodiment showing how the connecting pin is attached to a circuit board.
Figure 2B:
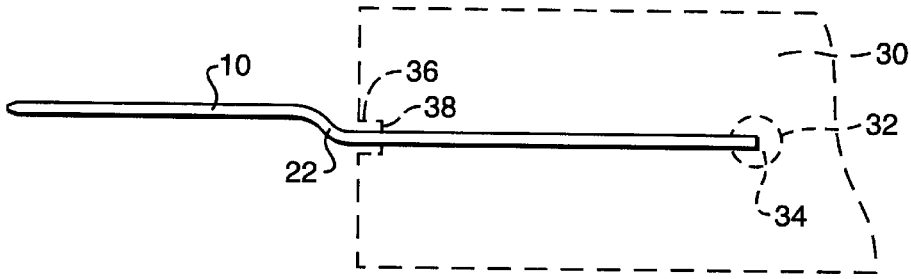
FIG. 2*b* is a top view of the embodiment of FIG. 2*a* showing the notch in the circuit board.

The attachment of connecting pin 100 to a circuit board is described with reference to FIGS. 2*a* and 2*b*. Connecting pin 100 is initially placed at an angle, such as shown by dotted line D, with pivot face 20 on an edge of a circuit board 30 to which connecting pin 100 is to be attached. Connecting pin 100 is then pivoted as shown by arrow E so that plug 14 is inserted into a suitable electrical receptacle 32 provided in circuit board 30. To this end, lower limb 19 may be tapered (see FIG. 1) to facilitate this pivoting motion. Plug 14 is spaced from pivot face 20 a distance that matches the distance from receptacle 32 to the edge of circuit board 30. In the preferred embodiment, the pin 100 is rotated until boss 23 braces against the circuit board, and plug 14 extends into receptacle 32. Lower limb 19, pivot face 20 and surface 23 closely trap the edge region of the circuit board. Plug 14 may be soldered 34 to an electrical connection provided on circuit board 30, preferably on a side of circuit board 30 opposite a side into which plug 14 is inserted. The combination of plug 14 inserted into receptacle 32 and clamping pivot arm 16 engaging an edge of circuit board 30 prevents movement of connecting pin 100 in a direction parallel to longitudinal axis C.

Circuit board 30 may have a notch 36 in its edge that receives clamping pivot arm 16, specifically its pivot face 20 (the width of the notch is exaggerated in the interest of clarity; its width should be similar to a width of the connecting pin). Thus, pivot face 20 rests on and pivots about the interior side 38 of notch 36. The combination of notch 36 and clamping pivot arm 16 prevents lateral movement of connecting pin 100 at the edge of circuit board 30.

Figure 3A:
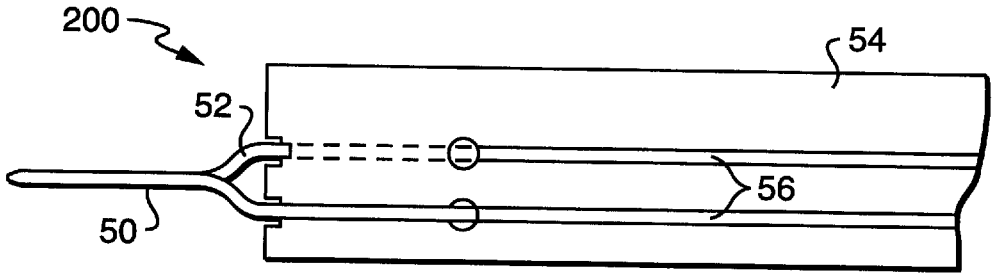
FIG. 3*a* is a top view of a second embodiment of the present invention that includes a pair of connecting pins and a circuit board.
Figure 3B:
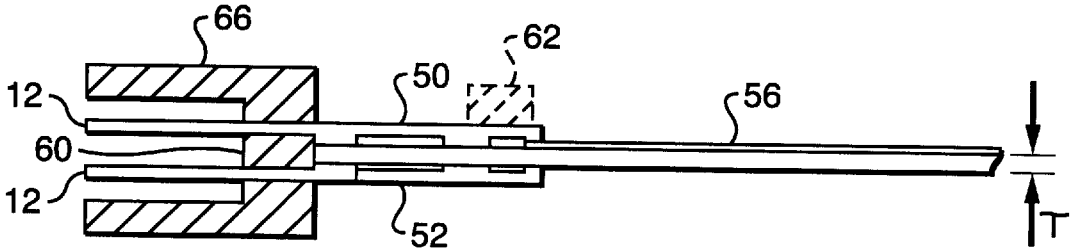
FIG. 3*b* is a side view of the embodiment of FIG. 3*a*.

A further embodiment 200 of the present invention that includes a pair of connecting pins 50, 52 and circuit board 54 is shown in FIGS. 3*a* and 3*b*. Each of pins 50, 52 may be similar to connecting pin 100 discussed above and board 54 may be similar to circuit board 30 discussed above. Pins 50 and 52 may be on opposite sides of board 54 and S-shaped portion 22 may be aligned so that pins 50 and 52 overlap in top view (FIG. 3*a*) and are spaced apart in side view (FIG. 3*b*). This permits the symmetrical arrangement of connecting pins 50, 52 as is typically required.

Board 54 may have a thickness T and pins 50, 52 may be correspondingly dimensioned so that their respective clamping pivot arms grasp board 54 without play.

Figure 4:
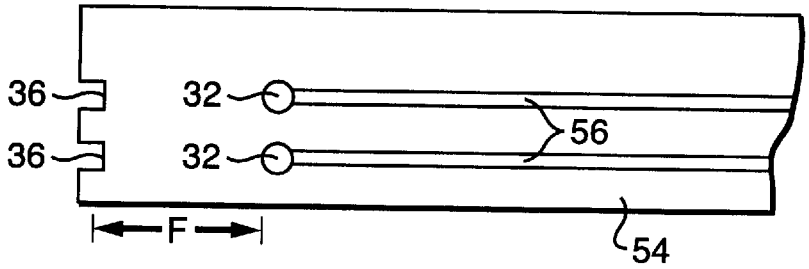
FIG. 4 is a top view of the circuit board of FIG. 3*a* without the connecting pins.

Board 54 is shown in FIG. 4.without the pins 50, 52 in the interest of clarity. The notches 36 are apparent, as are the electrical receptacles 32. Portions 56 of the circuit to which pins 50, 52 are connected are also shown. Receptacles 32 may be spaced a suitable distance F from the inside of notches 36.

Embodiment 200 may also include a device for preventing pins 50, 52 from pivoting together at first ends 12 after pins 50, 52 have been installed. This device may be used instead of the solder or in addition thereto as a means of locking the pins rotationally in place, or further strengthening the attachment of pins 50, 52 to board 54. It is understood that pins 50, 54 need to be electrically connected to the circuit structure, and that soldering the pins in the receptacles conveniently makes both a mechanical and an electrical connection. The device may be a block 60 between first ends 14 of pins 50, 52 adjacent to the edge of circuit board 54, or a restraint 62 (shown in dashed lines) that is affixed to board 54 and that holds rod 10. A ring 64 may surround first ends 12 of pins 50, 52 to prevent splaying of pins 50, 52. Pin cover 66 may also be provided and block 60 and ring 64 may be part of cover 66 (block 60, restraint 62, ring 64, and cover 66 are omitted from FIG. 3*a* in the interest of clarity).

While embodiments of the present invention have been described in the specification and drawings, it is to be understood that the present invention is defined by the following claims when read in light of the specification and drawings.

I claim:

1. A connector pin for a circuit board, the connector pin comprising:

an electrically conductive rod having a first end that is adapted to extend longitudinally from an edge of a circuit board;

an electrically conductive side-wise plug that is attached to said rod and that is adapted to be inserted into an electrical receptacle in a circuit board and that extends in a first direction transverse to a longitudinal axis of said first end; and a clamping pivot arm that is attached to said rod between said first end and said side-wise plug, said clamping pivot arm extending in the first direction and having a hook at an end thereof, said hook pointing toward said side-wise plug for pivotally engaging an edge of a circuit board and holding the connector pin in place on the edge of the circuit board when the connector pin is pivoted about said clamping pivot arm and said side-wise plug is inserted into a receptacle in the circuit board.

2. The connector pin of claim 1, wherein the longitudinal axis of said first end is offset from a longitudinal axis of said rod between said clamping pivot arm and said side-wise plug.

3. The connector pin of claim 1, wherein said side-wise plug is at a second end of said rod opposite said first end.

4. The connector pin of claim 1, wherein said rod, said side-wise plug, and said clamping pivot arm are a single piece of electrically conductive metal.

5. A combination of a connector pin and a circuit board, the circuit board comprising a board having an edge that has a first thickness and a first notch therein, said circuit board further comprising a first electrical receptacle therein that is spaced a first distance from an interior side of said first notch; and the connector pin comprising, an electrically conductive rod having a first end that extends longitudinally from said edge, an electrically conductive side-wise plug that is attached to said rod and that is inserted into said first electrical receptacle, said side-wise plug extending in a first direction transverse to a longitudinal axis of said first end, and a clamping pivot arm that is attached to said rod between said first end and said side-wise plug, said clamping pivot arm extending in the first direction and having a hook that points toward said side-wise plug and that pivotally engages said interior side of said first notch, an interior of said hook being spaced said first distance from said side-wise plug, wherein said side-wise plug and said hook prevent longitudinal movement of the connector pin relative to the circuit board and said notch prevents lateral movement of the connector pin relative to the circuit board.

6. The combination of claim 5, wherein the longitudinal axis of said first end is offset from a longitudinal axis of said rod between said clamping pivot arm and said side-wise plug.

7. The combination of claim 5, wherein said side-wise plug is at a second end of said rod opposite said first end.

8. The combination of claim 5, wherein said rod, said side-wise plug, and said clamping pivot arm are a single piece of electrically conductive metal.

9. The combination of claim 5, wherein said side-wise plug is soldered to said first electrical receptacle on a side of said board opposite a side into which said side-wise plug was inserted.

10. The combination of claim 5, wherein a lower limb of said hook is spaced from said rod by said first thickness.

11. The combination of claim 5, further comprising a restraint on said rod between said plug and said clamping pivot arm that is connected to said board and that holds said connector pin to said board.

12. The combination of claim 5, wherein said edge of said board further comprises a second notch therein adjacent to said first notch and a second electrical receptacle adjacent to said first electrical receptacle and spaced the first distance from an interior side of said second notch, and further comprising a second said connector pin that engages said second notch and said second electrical receptacle.

13. The combination of claim 12, wherein for each of said first and second connector pins the longitudinal axis of said first end is offset from a longitudinal axis of said rod between said clamping pivot arm and said side-wise plug, and wherein said first ends of said first and second connector pins are closer to each other than are said rods between said clamping pivot arm and said side-wise plug.

14. The combination of claim 12, wherein said first and second connector pins are on opposite sides of said board.

15. The combination of claim 12, further comprising a block adjacent to said edge of said board and between said first ends of said first and second connector pins for preventing coming together of said first ends.

16. The combination of claim 12, further comprising a ring surrounding said pins at said first ends.

17. A connector pin for electrically connecting a circuit on a circuit board to an external fitting, said connector pin comprising:

a rigid, longitudinally extended, electrically conductive rod having forwardly and rearwardly extending, spaced apart, generally parallel portions connected by a generally S-shaped portion;

said forwardly extending portion terminating in a tapered end for longitudinal and electrically conductive insertion into an external fitting;

said rearwardly extending portion having a longitudinal axis that is offset from a longitudinal axis of said forwardly extending portion by said S-shaped portion, said rearwardly extending portion having two, parallel, spaced apart arms that extend in a direction orthogonal to the longitudinal axis of said rearwardly extending portion, a first one of said two arms being at an end of the connector pin opposite said tapered end of said forwardly extending portion and having an end for electrically conductive insertion into an electrical receptacle in a circuit board, a second one of said two arms being adjacent to said S-shaped portion and having a pivot face orthogonal to the longitudinal axis of said rearwardly extending portion and on which the connector pin pivots to insert said first one of said two arms into an electrical receptacle of a circuit board, said second one of said two arms terminating in an L-shaped portion whose lower limb is parallel to the longitudinal axis of said rearwardly extending portion and points toward said first one of said two arms, and which, together with said rearwardly extending portion, is adapted to grasp an edge of a circuit board, whereby placement of said pivot face on an edge of a circuit board and pivoting of said connecting pin about said pivot face places said first one of said two arms into electrical engagement with an electrical receptacle in the circuit board and simultaneously holds said connecting pin on the edge of the circuit board.

* * * * *